United States Patent [19]

Aichinger et al.

[11] Patent Number: 5,060,251

[45] Date of Patent: Oct. 22, 1991

[54] X-RAY DIAGNOSTICS GENERATOR HAVING A ROTATING ANODE X-RAY TUBE

[75] Inventors: Horst Aichinger, Fuerth; Albert Moosmann, Erlangen, both of Fed. Rep. of Germany

[73] Assignee: Siemens Aktiengesellschaft, Munich, Fed. Rep. of Germany

[21] Appl. No.: 578,663

[22] Filed: Sep. 7, 1990

[30] Foreign Application Priority Data

Oct. 4, 1989 [EP] European Pat. Off. ..... 89118401

[51] Int. Cl.[5] ..... H05G 1/66

[52] U.S. Cl. ..... 378/93; 378/94; 378/125; 378/144

[58] Field of Search ..... 378/93, 94, 125, 144

[56] References Cited

U.S. PATENT DOCUMENTS

| | | | |
|---|---|---|---|
| 3,943,356 | 3/1976 | Schmutzer et al. | 378/94 |
| 4,316,129 | 2/1982 | Shapiro et al. | 378/94 |
| 4,519,093 | 5/1985 | Kurihara et al. | 378/132 |

FOREIGN PATENT DOCUMENTS

| | | | |
|---|---|---|---|
| 0051295 | 5/1982 | European Pat. Off. . | |
| 1239783 | 5/1967 | Fed. Rep. of Germany . | |
| 06154499 | 12/1985 | Japan . | |
| 61-153932 | 11/1986 | Japan . | |
| 0570227 | 8/1977 | U.S.S.R. | 378/94 |

*Primary Examiner*—Edward P. Westin
*Assistant Examiner*—Don Wong
*Attorney, Agent, or Firm*—Hill, Van Santen, Steadman & Simpson

[57] ABSTRACT

An x-ray diagnostics generator which includes a rotating anode x-ray tube includes circuitry for setting the speed of rotation of the anode dependent on exposure parameters. At particular rotational speeds, the motor bearing for the rotating anode is subject to mechanical resonances, causing vibrations which can damage the bearing. A vibration detector is provided in mechanical contact with the x-ray tube, and when vibrations due to such mechanical resonances are sensed, a signal is provided from the detector to a processor which automatically slightly alters the rotational speed.

1 Claim, 1 Drawing Sheet

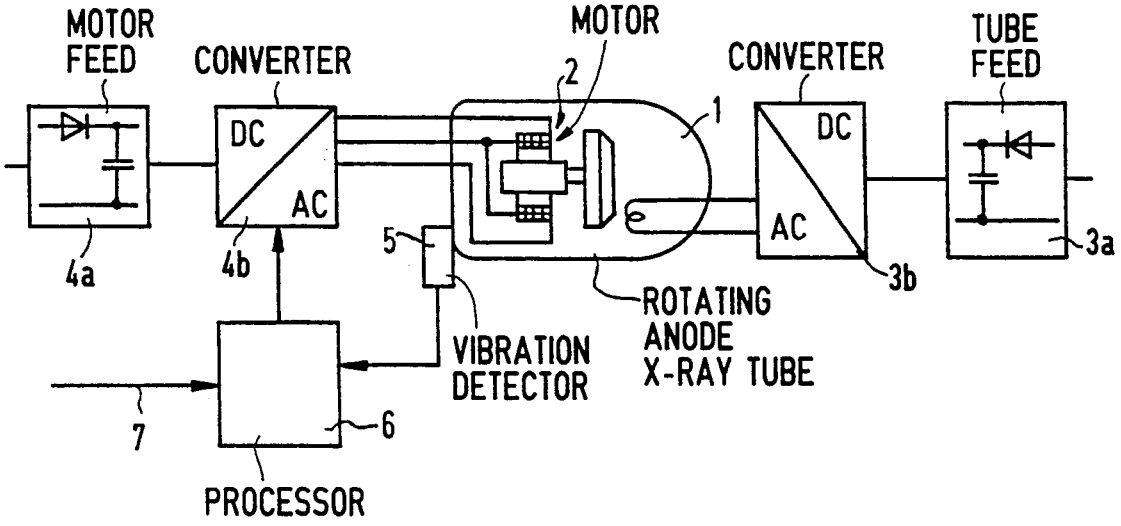
MOTOR
FEED
CONVERTER
DC
AC
MOTOR
2
1
CONVERTER
DC
AC
TUBE
FEED
4a
4b
5
3b
3a
ROTATING
ANODE
X-RAY TUBE
VIBRATION
DETECTOR
7
6
PROCESSOR

X-RAY DIAGNOSTICS GENERATOR HAVING A ROTATING ANODE X-RAY TUBE

BACKGROUND OF THE INVENTION

1. Field of the Invention

The present invention is directed to an x-ray generator for use in an x-ray diagnostics system, and in particular to such a generator which includes a rotating anode x-ray tube and a feed circuit for the rotating anode motor.

2. Description of the Prior Art

In the operation of rotating anode x-ray tubes, it is known for high frequency x-ray generators to use a high frequency feed voltage for the x-ray tube, which is acquired from the mains via a d.c.-a.c. converter and through a rectifier, and also to feed the rotating anode motor via a rectifier and a d.c.-a.c. converter. It is thus possible to set the feed frequency for the rotating anode motor, and thereby to set the anode speed, so that the anode speed can be optimally adapted to prevailing exposure parameters.

When the anode speed is set, it is possible that the speed will assume one or more values at which mechanical resonant vibrations occur in the motor bearings in which the anode is supported. The bearings can be damaged as a result of these vibrations.

SUMMARY OF THE INVENTION

It is an object of the present invention to provide an x-ray diagnostics generator having a rotating anode x-ray tube wherein the appearance of resonant vibrations in the anode bearing is prevented upon a setting of the anode speed.

The above object is achieved in accordance with the principles of the present invention in an x-ray generator having a vibration detector in mechanical contact with the rotating anode x-ray tube, the vibration detector supplying an electrical signal to a processing unit upon the detection of vibrations resulting form the appearance of mechanical resonances in the motor bearing. The processing unit automatically undertakes a correction in the drive frequency in an upward or downward direction, so that the rotational speed of the anode is slightly altered so that the resonant vibrations disappear.

DESCRIPTION OF THE DRAWINGS

The single FIGURE is a schematic block diagram of an x-ray diagnostics generator constructed in accordance with the principles of the present invention.

DESCRIPTION OF THE PREFERRED EMBODIMENTS

As shown in the drawing, a rotating anode x-ray tube 1 has a rotating anode motor 2 with bearings therein in which the anode is supported. A tube feed circuit 3*a* supplies an anode voltage and the heating voltage via a d.c.-to-a.c. converter 3*b*. The rotating anode motor 2 is supplied with a feed voltage from the mains by a motor feed circuit 4*a*, also followed by a d.c.-to-a.c. converter 4*b*. Each of the feed circuits 3 and 4 contain a power rectifier.

The speed of rotation of the rotating anode is controlled by a processor 6 connected to the converter 4*b*. The processor 6 receives signals on an input line 7 corresponding to a rated value for the anode speed calculated by a computer (not shown) in a known manner based on the prevailing exposure data.

Certain rotational speeds of the anode will result in one or more mechanical resonances arising in the motor bearing. These resonances, if permitted to persist, can result in vibrations which may damage the motor bearing. Accordingly, a vibration detector 5 is disposed in mechanical contact with the rotating anode x-ray tube 1. Upon the detection of vibrations due to such mechanical resonances, the vibration detector 5 supplies a signal to the processor 6, which in turn slightly alters the rotational speed of the anode so that the mechanical resonances is no longer present. The anode speed may be varied slightly upwardly or downwardly.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray generator for diagnostics comprising:

an x-ray tube having an anode seated in a motor bearing and means for rotating said anode;

control means connected to said means for rotating for setting the rotational speed of said anode, said motor bearing being subjected to mechanical resonances causing vibrations at particular rotational speeds; and means in mechanical contact with said x-ray tube for detecting vibrations and for supplying a signal to said control means for altering the rotational speed of said anode upon the occurrence of a mechanical resonance for substantially eliminating said mechanical resonance and thereby minimizing said vibrations.

* * * * *